US006371543B1

(12) United States Patent
Fujikawa et al.

(10) Patent No.: US 6,371,543 B1
(45) Date of Patent: Apr. 16, 2002

(54) SLING

(75) Inventors: Masaru Fujikawa; Koji Saai, both of Osaka (JP)

(73) Assignee: Elephant Chain Block Co., Ltd. (JP)

( * ) Notice: Subject to any disclaimer, the term of this patent is extended or adjusted under 35 U.S.C. 154(b) by 0 days.

(21) Appl. No.: 09/638,899

(22) Filed: Aug. 15, 2000

(30) Foreign Application Priority Data

Apr. 28, 2000 (JP) ..... 12-130198
Jun. 8, 2000 (JP) ..... 12-171368

(51) Int. Cl.[7] ..... B66C 1/66

(52) U.S. Cl. ..... 294/82.13; 294/82.11; 294/90; 414/607

(58) Field of Search ..... 294/82.11, 82.13, 294/82.2, 82.33, 74, 90, 104, 31.1, 101; 59/93; 116/212, 296; 414/607

(56) References Cited

U.S. PATENT DOCUMENTS

| | | | | | |
|---|---|---|---|---|---|
| 569,448 | A | * | 10/1896 | Dudley | 294/82.12 |
| 2,139,294 | A | * | 12/1938 | Weigant | 294/82.1 |
| 2,315,146 | A | * | 3/1943 | White | 294/74 |
| 2,361,463 | A | * | 10/1944 | Dorton | 294/31.1 |
| 2,703,476 | A | * | 3/1955 | Donaldson | 59/93 |
| 3,330,591 | A | * | 7/1967 | Pavelka | 294/104 |
| 3,333,883 | A | * | 8/1967 | Kikuchi | 294/31.1 |
| 3,352,591 | A | * | 11/1967 | Casey | 294/90 |
| 3,527,493 | A | * | 9/1970 | Phares | 294/74 |
| 3,621,651 | A | * | 11/1971 | Gillspie | 59/93 |
| 4,032,181 | A | * | 6/1977 | Money, Sr. | 294/31.1 |
| 4,068,467 | A | * | 1/1978 | Schreyer et al. | 294/82.11 |
| 4,073,175 | A | * | 2/1978 | Seamon | 294/82.11 |
| 4,176,874 | A | * | 12/1979 | Archer | 294/82.12 |
| 4,213,647 | A | * | 7/1980 | Thurmond, Jr. | 294/90 |
| 4,249,474 | A | * | 2/1981 | Archer | 294/74 |
| 4,832,391 | A | * | 5/1989 | Moell | 294/74 |
| 4,941,698 | A | * | 7/1990 | Klibert et al. | 294/82.12 |
| 5,292,165 | A | * | 3/1994 | Wiklund | 294/82.33 |
| 5,775,754 | A | * | 7/1998 | Fredricksson | 294/82.11 |
| 5,975,603 | A | * | 11/1999 | Novak-Taurman et al. | 294/90 |

FOREIGN PATENT DOCUMENTS

| | | | | |
|---|---|---|---|---|
| CA | 954557 | * | 9/1974 | 294/90 |
| DE | 2138919 | * | 10/1984 | |
| DE | 3903138 | * | 8/1989 | 294/82.12 |
| GB | 870578 | * | 6/1961 | 294/82.1 |
| JP | 59-46977 | | 3/1984 | |
| SU | 514767 | * | 9/1976 | 294/90 |
| SU | 1373669 | * | 2/1988 | 294/82.12 |

* cited by examiner

*Primary Examiner*—Dean J. Kramer
*Assistant Examiner*—Paul T. Chin
(74) *Attorney, Agent, or Firm*—George T. Marcou; Kilpatrick Stockton LLP

(57) ABSTRACT

A sling capable to easily raise a hanging load such as a drum with a simplified structure. In a chain sling (or a wire sling) in which a master link and hooks are connected with each other via link chains (or wire ropes), lower portions of the hooks are formed to be bent at an angle smaller than 90° and also a bottom portion of the master link is flattened. With this structure, even when the drum has no ring-like protrusion at which an upper lid is mounted, if holes are formed around the side of the drum, the front ends of the hooks can be reliably hooked in the holes to raise the drum. Also, when a lifting portion of a forklift is brought into contact with the flattened bottom portion of the master link, the drum can be easily slung by the forklift as well.

1 Claim, 15 Drawing Sheets

Prior Art

Prior Art

SLING

BACKGROUND OF THE INVENTION

1. Technical Field

This invention relates to a sling such as a chain sling, a wire sling or a belt sling and, more particularly, to a sling suitably used to support or raise a drum and the like.

2. Description of the Prior Art

In the slinging work of drums and the like, chain slings and similar slings have been widely used. A typical type of chain sling has a master link 1 to be hooked by a lower hook of a lifting machine such as a crane or a chain block, hooks 3 to be clamped onto a drum 2 and link chains 4 connecting between the master link 1 and the hooks 3, as shown in FIG. 26.

Each hook 3 comprises a hook body 5 having an upper portion of a hooked shape and a lower portion of a generally L-shape and a grip portion 6 of a hooked shape which is swingably mounted at the upper portion of he hook body 5. When the drum 2 is held by the sling, the hook bodies 5 are put into abutment with side portions of the drum 2 at front ends of the generally L-shaped lower portions thereof and also clamp a ring-like protruding portion of the drum 2, at which an upper lid 7 closing an upper opening of the drum 2 is mounted, by rear ends of the hooked-shaped upper portions and the grip portions 6.

The master link 1 has curved lower portions and connecting portions 8 projecting downwardly from the lower portions so as to be connected with the link chains. The connecting portions 8 have insertion holes formed along a plane containing a direction orthogonal to a plane containing the master link 1. Inserted in the insertion holes are support shafts 9, on which upper ends of the link chains 4 are supported.

This conventional type of chain sling has the disadvantage of being unable to raise the drum 2 which is varied by, for example, cutting it in half, after the upper lid 7 of the drum 2 is opened, so that only the lower half can be used as a container. This is because the drum no longer has the ring-like protrusion portion at which the upper lid 7 is mounted and has no parts to be clamped in sandwich relation between the rear ends of the upper portions and the grip portions 6 of the hook bodies 5.

Also, the master link 1 is usually raised by a crane or a chain block but sometimes is raised by a forklift and the like. In the latter case, the conventional arrangement of the connecting portions 8 being formed to project downwardly from the lower portion of the master link 1 has the disadvantage that the downwardly projecting connecting portions 8 abut with a lifting portion of the forklift to hinder a stable support of the master link 1.

It is the object of the present invention to provide a sling capable to easily raise a hanging load such as a drum with a simplified structure.

SUMMARY OF THE INVENTION

The present invention is directed to a novel sling comprising a master link, hooks and flexible string-like members for connecting between said master link and said hooks, wherein lower portions of the hooks are formed to be bent at an angle smaller than 90°.

With this construction, since the lower portions of the hooks are bent at an angle smaller than 90°, for example if the drum with no protrusion to be hooked is provided, around its side surface, with holes to insert therein the front ends of the hooks, then the front ends of the hook can reliably be hooked in the inside of the drum. Thus, the sling of the present invention has the capability to reliably hold the drum with the hooks even when an upper lid is opened and the drum has no protrusion, thus ensuring the good raising work.

According to the present invention, in the sling in which the master link and the hooks are connected with each other with flexible string-like members, a flat portion is formed on at least a part of a bottom of the master link.

With this arrangement, since the flat portion is formed on the bottom of the master link, for example when a lifting portion of the forklift is inserted and is abutted with the flat portion of the master link, the master link can then be stably supported by the lifting portion. Thus, the chain sling of the present invention can be used with the forklift as well as the crane and chain block with ease and reliability to raise the drum.

In this embodiment, it is preferable that connecting portions to be connected with the flexible string-like members are formed in the master link at places above the flat portions.

With the arrangement in which the connecting portions are formed at places above the flat portions, when the master link is raised by the forklift, the lifting portion of the forklift is surely brought into contact with the flat portion of the master link without contacting with the connecting portions. Due to this, the master link can be raised further reliably even by the forklift.

It is preferable that the connecting portions have insertion holes formed along a plane containing the master link, and the flexible string-like members are supported by support shafts inserted in the insertion holes.

With the arrangement in which the insertion holes are formed along a plane containing the master link, the simple machining work of the insertion holes and the reliable support of the flexible string-like members can be yielded, as compared with the arrangement of the insertion holes being formed along, for example, a plane containing a direction orthogonal to a plane containing the master link. In addition, the replacement of the support shafts can be facilitated.

DESCRIPTION OF THE PREFERRED EMBODIMENTS

With reference to the accompanying drawings, preferred embodiments of a sling in accordance with the present invention will be described below.

Figure 1:
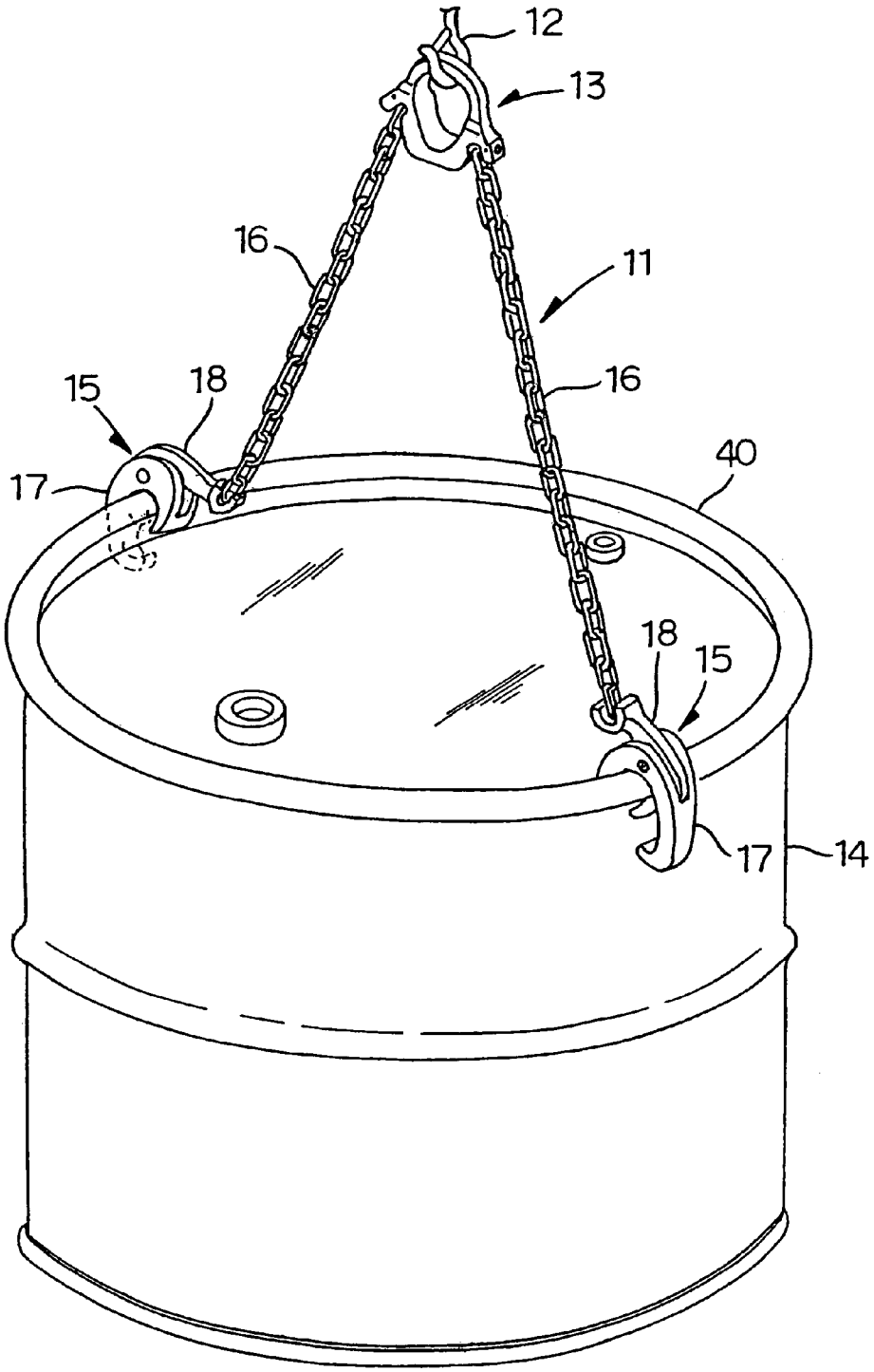
FIG. 1 is a perspective view of a chain sling as one embodied form of the sling of the present invention.
Figure 2:
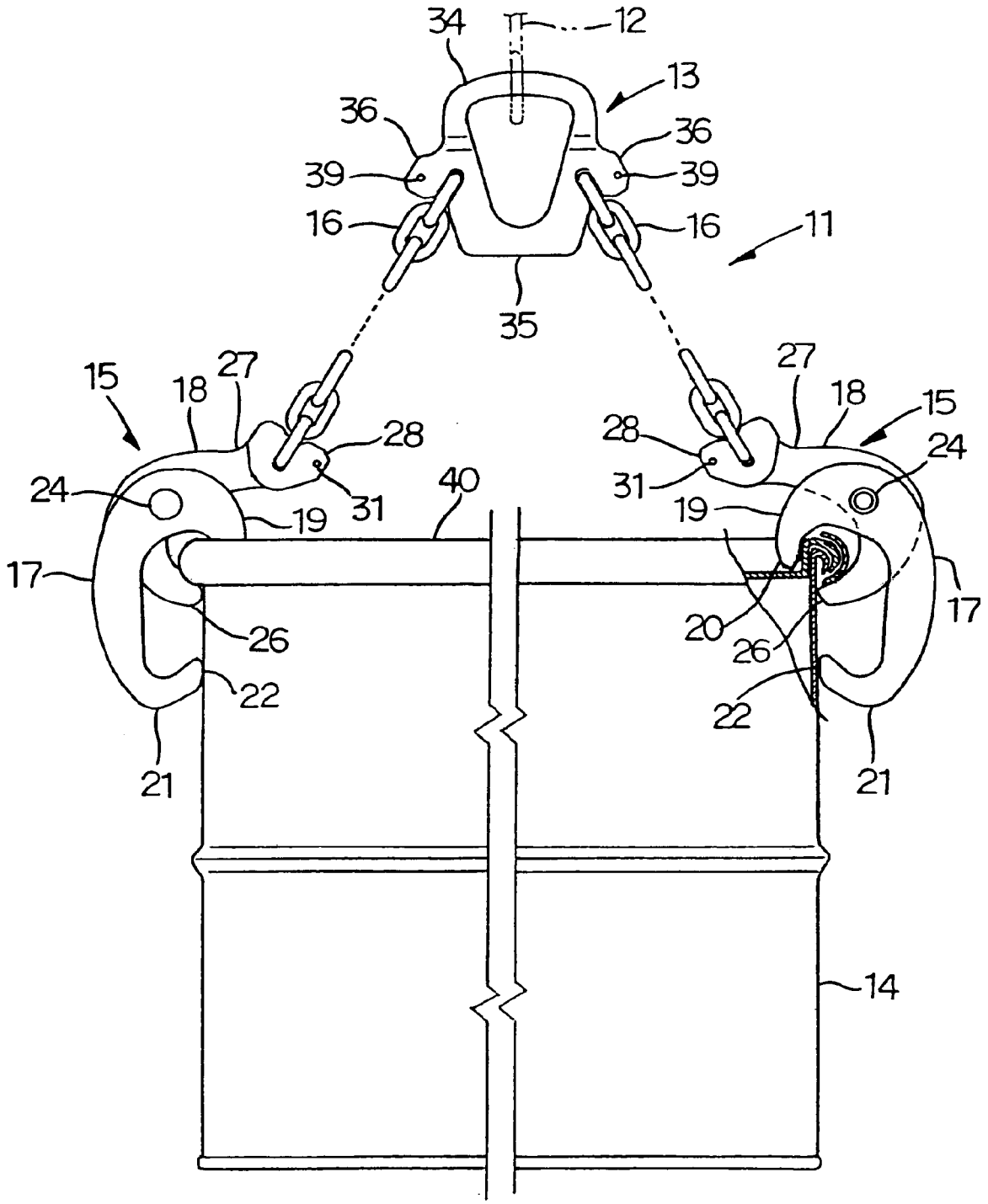
FIG. 2 is a front view of FIG. 1.
Figure 3:
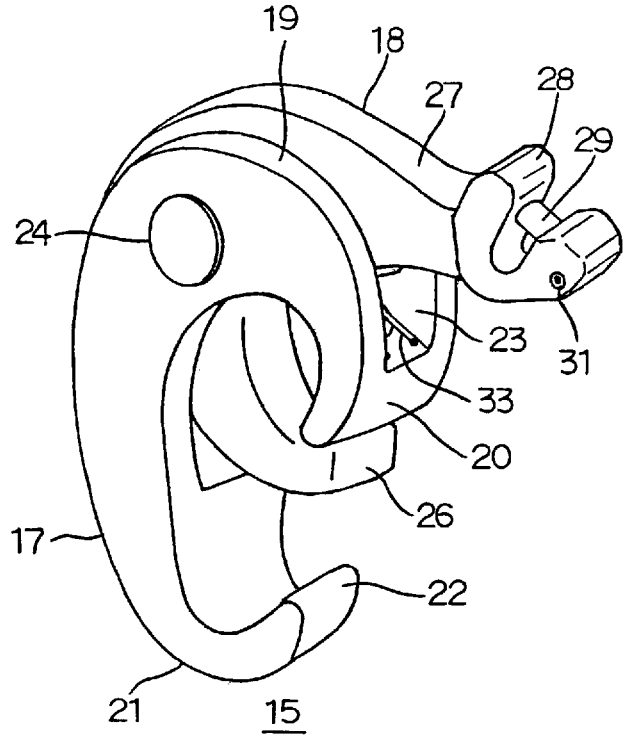
FIG. 3 is a perspective view of a hook of the chain sling shown in FIG. 1.
Figure 4:
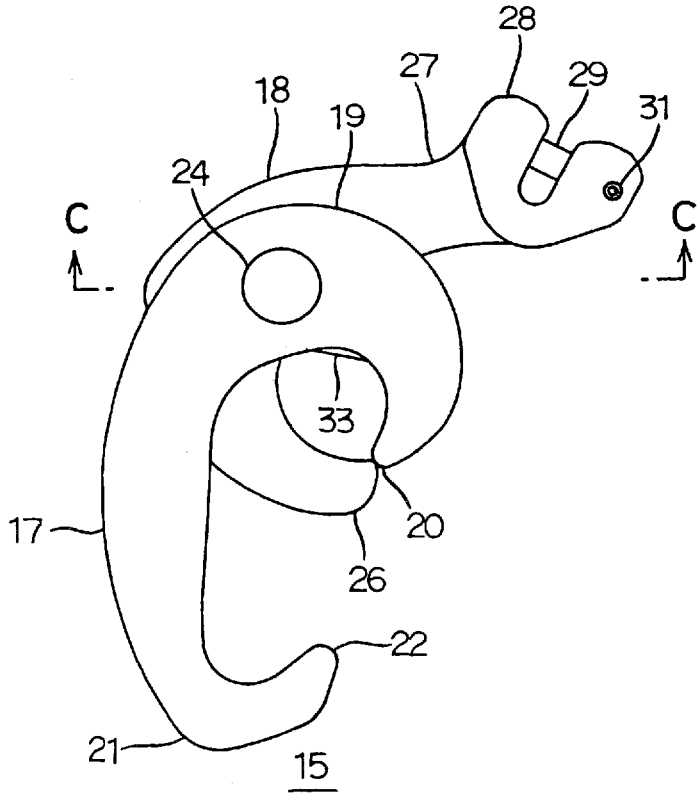
FIG. 4 is a front view of the hook of the chain sling shown in FIG. 1.
Figure 5:
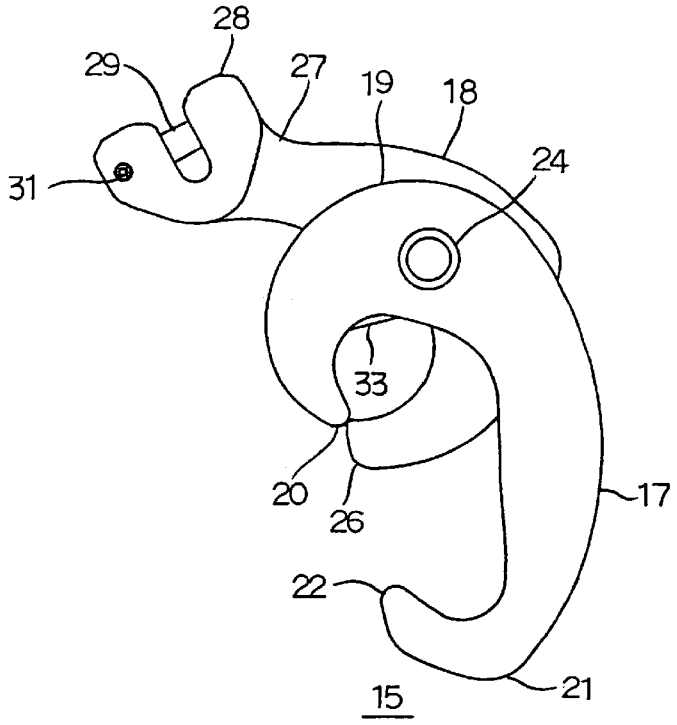
FIG. 5 is a rear view of the hook of the chain sling shown in FIG. 1.
Figure 6:
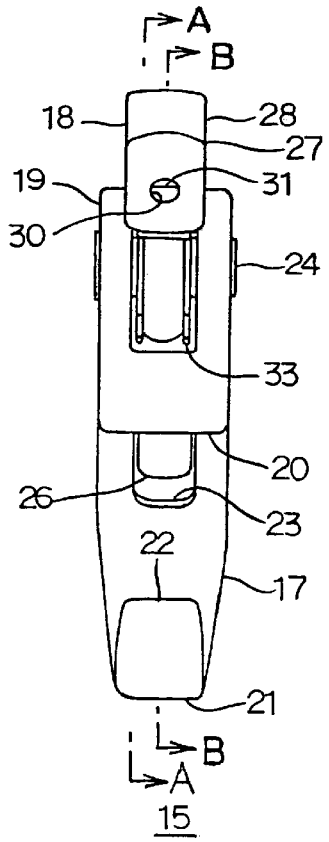
FIG. 6 is a right side view of the hook of the chain sling shown in FIG. 1.
Figure 7:
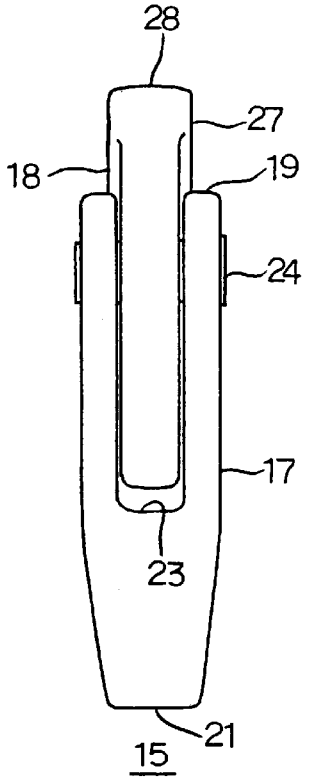
FIG. 7 is a left side view of the hook of the chain sling shown in FIG. 1.
Figure 8:
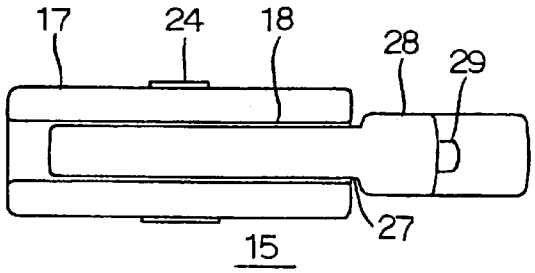
FIG. 8 is a plan view of the hook of the chain sling shown in FIG.1.
Figure 9:
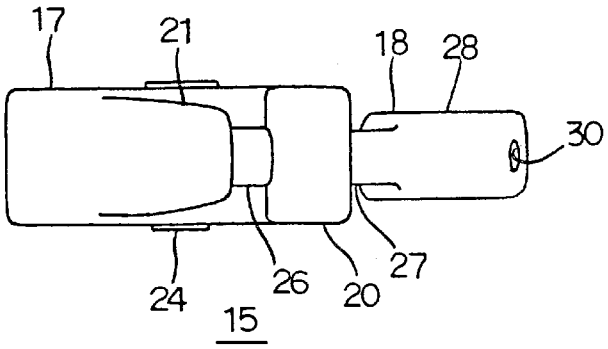
FIG. 9 is a bottom view of the hook of the chain sling shown in FIG. 1.

Referring to FIG. 1, there is shown a perspective view of a chain sling as one embodied form of the sling of the present invention. FIG. 2 is the front view thereof.

In FIGS. 1 and 2, the chain sling 11 is used to raise a drum 14 and the like by use of a lifting machine such as a crane or a chain block. In the chain sling 11, a master link 13 to be hooked by a lower hook 12 of the lifting machine such as the crane or the chain block and two hooks 15 to be clamped onto the drum 14 are connected with each other via link chains 16 as flexible string-like members.

Each hook 15 comprises a hook body 17 formed into a generally C-shape and a grip portion 18 of a hooked shape which is swingably mounted on the hook body 17, as shown in FIGS. 3 through 12. The hook body 17 has an upper portion 19 and a lower portion 21. The upper portion 19 is formed into a shape circularly curved toward a rear end, so that the rear end 20 of the upper portion 19 orients to a downward direction from a horizontal direction in the state of being clamped onto the drum 14. The lower portion 21 is formed into a hooked shape (J-shape) bent at an angle smaller than 90° toward a front end, so that the front end 22 of the lower portion 21 orients to an upward direction from the horizontal direction.

The hook body has an opening 23, formed partway along its length from the upper portion 19 to the lower portion 21, for receiving the grip portion 18 in an insertable manner. The upper portion 19 having the opening 23 partway along its length has a through hole 25 which is formed to extend through the hook body 17 in the thickness direction, for insertion and support of a pivot shaft 24.

Figure 11:
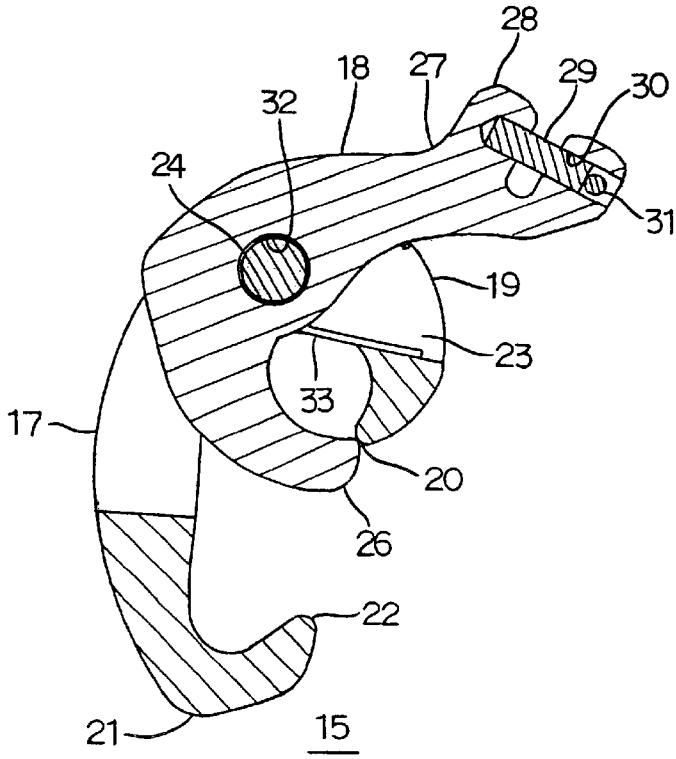
FIG. 11 is a sectional view taken along line B—B of FIG. 6.
Figure 12:
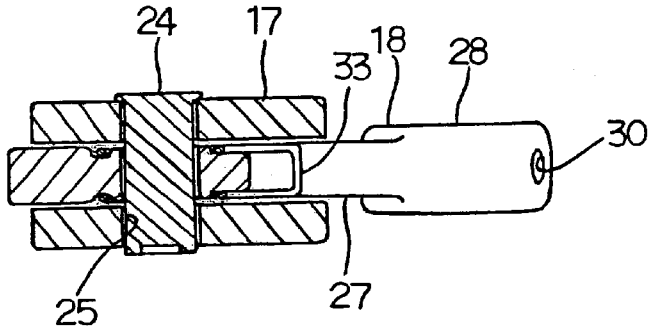
FIG. 12 is a sectional view taken along line C—C of FIG. 4.
Figure 13:
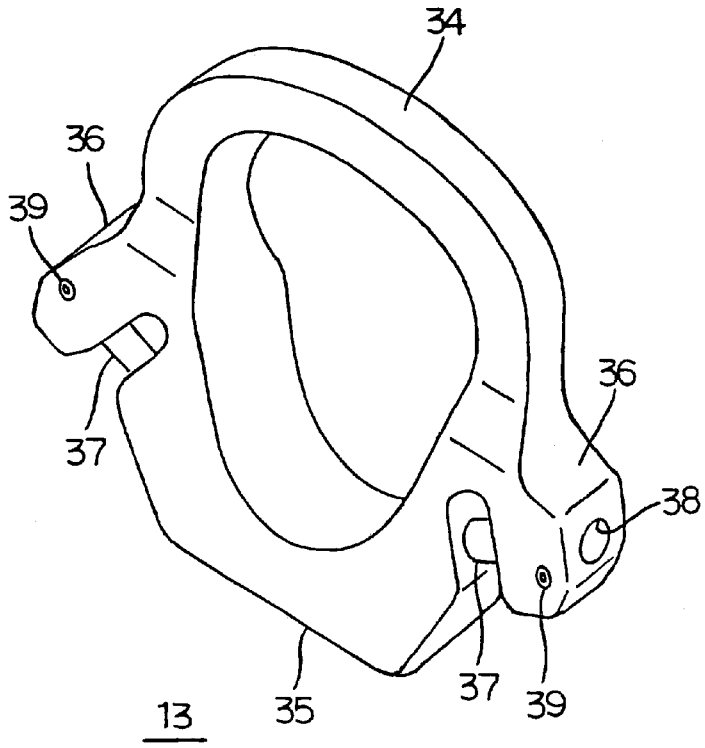
FIG. 13 is a perspective view of a master link of the chain sling shown in FIG. 1.
Figure 14:
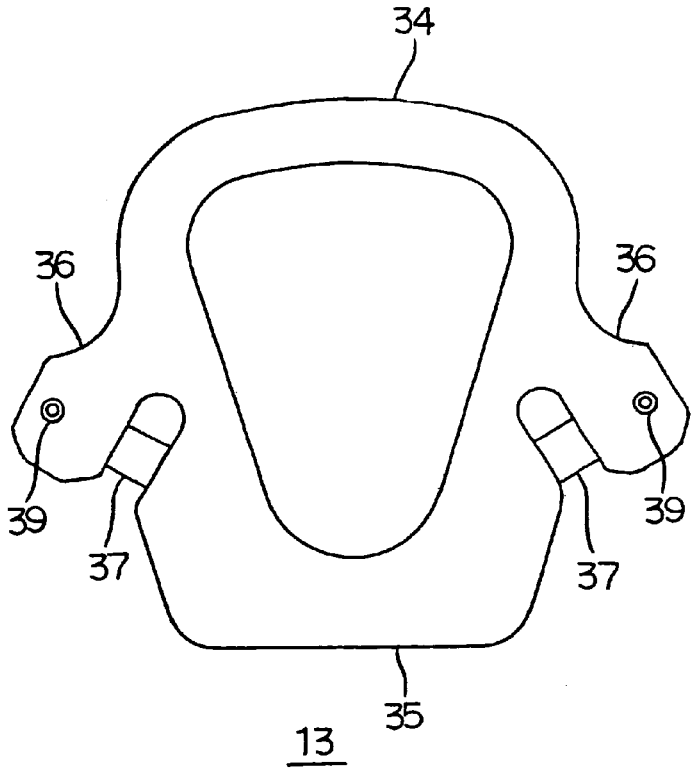
FIG. 14 is a front view of the master link of the chain sling shown in FIG. 1.
Figure 15:
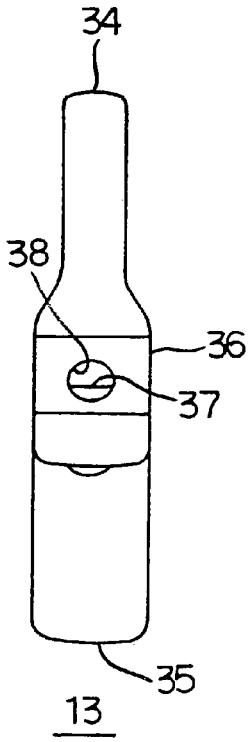
FIG. 15 is a right side view of the master link of the chain sling shown in FIG. 1.
Figure 16:
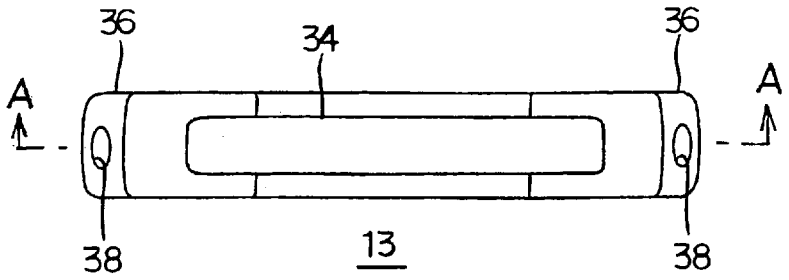
FIG. 16 is a plan view of the master link of the chain sling shown in FIG.1.
Figure 17:
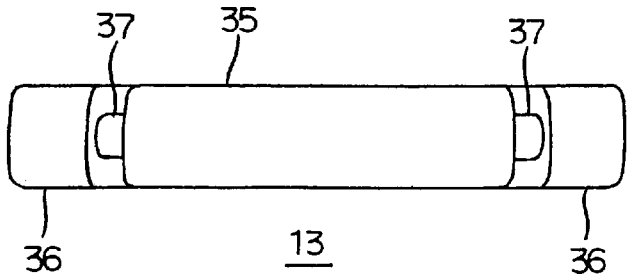
FIG. 17 is a bottom view of the master link of the chain sling shown in FIG. 1.

The grip portion 18 has a lower portion 26 and an upper portion 27. The lower portion 26 is curved into a generally J-shape. The upper portion 27 has a connecting portion 28 to be connected with a lower end of the link chain 16. The connecting portion 28 is formed into a generally U-shape in section toward its free end. The connecting portion 28 has an insertion hole 30 for fitting a support shaft 29 therein. The insertion hole 30 is formed to extend along a plane containing the grip portion 18 in the direction orthogonal to an opening of the connecting portion 28 of the generally U-shape section. The support shaft 29 is inserted in the insertion hole and the link at the lower end of the link chain 16 in the state in which the link at the lower end of the link chain 16 is fitted in the opening of the connecting portion 28 formed into the generally U-shape in section and thereby the lower end of the link chain 16 is connected with the grip portion 18. The support shaft 29 is fixed at its rear end by a locking pin 31 embedded in the grip portion 18 in the direction orthogonal to the inserting direction of the support shaft 29, as shown in FIG. 11. The grip portion 18 has a through hole 32 for fitting the pivot shaft 24 therein at a place between the upper end 27 and the lower end 26. The through hole 32 is formed to extend through the grip portion 18 in the thickness direction thereof.

The grip portion 18 is inserted in the opening 23 of the hook body 17 and is swingably supported to the hook body 17 by the pivot shaft 24 being fixedly fitted in the through holes 25 of the hook body 17 and 32 of the grip portion 18 in the state in which the through hole 25 and the through hole 32 are aligned with each other.

Figure 10:
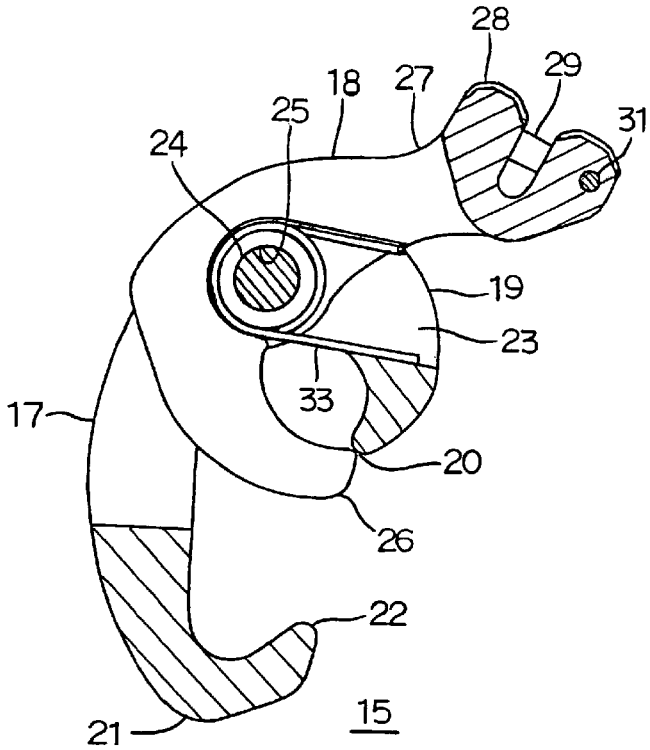
FIG. 10 is a sectional view taken along line A—A of FIG. 6.

The pivot shaft 24 winds thereon a torsion spring 33, one end of which is abutted with a lower surface of the upper portion 27 of the grip portion 18 and the other end of which is abutted with a side surface of the opening 23 at the upper portion 19 of the hook body 17, as shown in FIG. 10. The front end of the lower portion 26 of the grip 18 is always forced to abut with the rear end 20 of the hook body 17 by the biasing force of the torsion spring 33.

Figure 18:
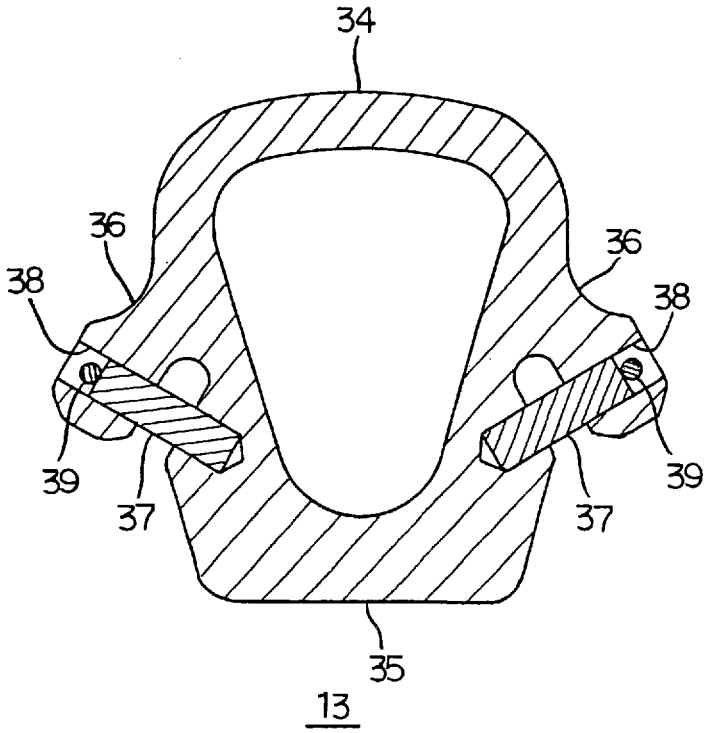
FIG. 18 is a sectional view taken along line A—A of FIG. 16.

The master link 13 has a generally rectangular ring-like shape, as shown in FIGS. 13 through 18, having an upper portion 34 curved into a generally segment form and a bottom portion or a lower portion 35 formed into a flat portion of flatness. Also, the master link 13 has, at both sides thereof, connecting portions 36 formed at places above the lower portion 35 and partway along its vertical length, respectively, to be connected with upper ends of the link chain 16. The connecting portions 36 are formed into a generally U-shape in section thereat in such a manner that two openings can widen toward a lower place. Each connecting portion 36 has an insertion hole 38 formed to extend along a plane containing the master link 13 in the direction orthogonal to the openings formed into a generally U-shape in section, for fitting a support shaft 37. The support shafts 37 are inserted in the insertion holes 38 and the links at the upper ends of the link chain 16 in the state in which the links at the upper ends of the link chain 16 are fitted in the openings of the connecting portions 36 formed into the generally U-shape in section and thereby the upper ends of the link chain 16 are connected with the master link 13. The support shafts 37 are fixed at their rear ends by locking pins 39 embedded in the master link 13 in the direction orthogonal to the inserting direction of the support shaft 37, as shown in FIG. 18.

Figure 19:
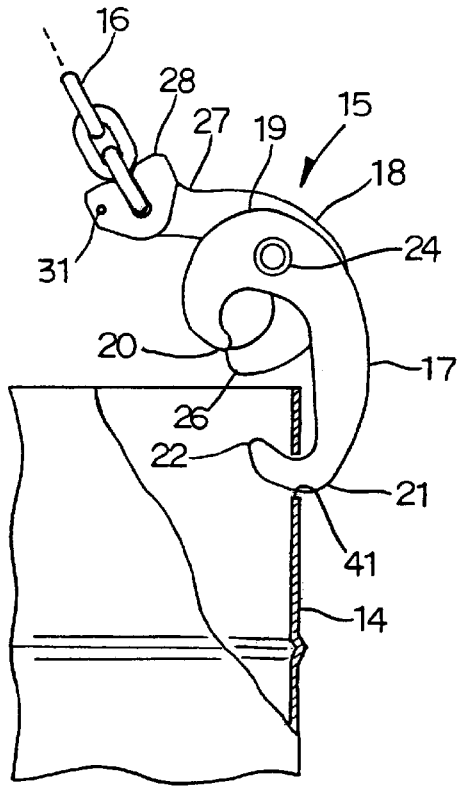
FIG. 19 is an illustration of the state of use of the hook of the chain sling shown in FIG. 1.

In general use of the chain sling 11 thus constructed, the ring-like protruding portion of the drum 14 at which an upper lid 40 is mounted is clamped in sandwich relation between the lower portions 26 of the grip portions 18 and the rear ends 20 of the hook bodies 17 via biasing force of the torsion springs 33 and also side portions of the drum 14 are put into abutment with the hook bodies 17 at front ends 22, so as to hold the drum 14, as shown in FIG. 2. In addition, the upper portion 34 of the master link 13 is hooked by the lower hook 12 of the crane or the chain block to sling or raise the drum 14 by the crane or the chain block, In the lifting work of the drum 14, for example, in the case where after the upper lid 40 of the drum 14 is opened, the drum 14 is cut in half so that only the lower half can be used as a container, the drum 14 cannot be clamped in sandwich relation between the lower ends 26 of the grip portions 18 and the rear ends 20 of the hook bodies 17, because the drum no longer has the ring-like protrusion portion at which the upper lid 40 is mounted. However, with the chain sling 11 of the present invention, since the lower portions 21 of the hook bodies 17 are bent at an angle smaller than 90° so that the front ends 22 of the lower portions 21 orient to an upward direction from the horizontal direction in the state in which the front ends 22 hold the drum 14, for example if the drum 14 is provided, around its side surface, with holes 41 to insert therein the front ends 22 of the hook bodies 17, then the front ends 22 can reliably be hooked in the inside of the drum 14, as shown in FIG. 19. Thus, the sling of the present invention has the capability to reliably hold the drum 14 with the hooks 15 even when the drum 14 has no ring-like protrusion portion at which the upper lid 40 is mounted, thus ensuring the adequate raising work.

Figure 20:
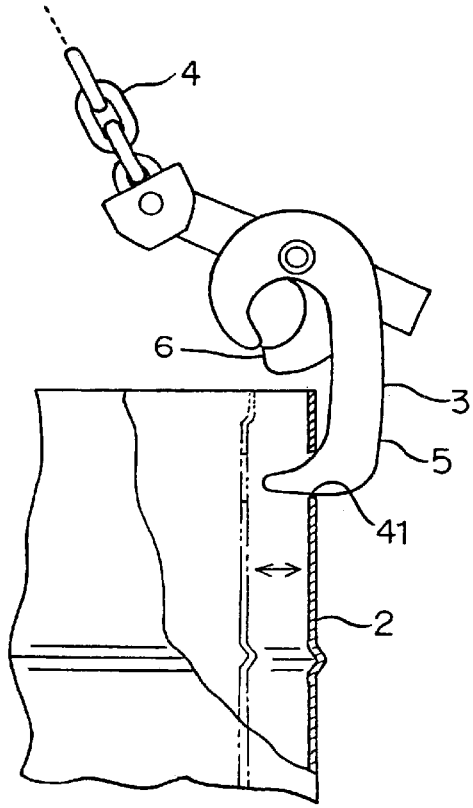
FIG. 20 is an illustration corresponding to FIG. 19 of the state of use of a hook of a conventional type of chain sling.
Figure 26:
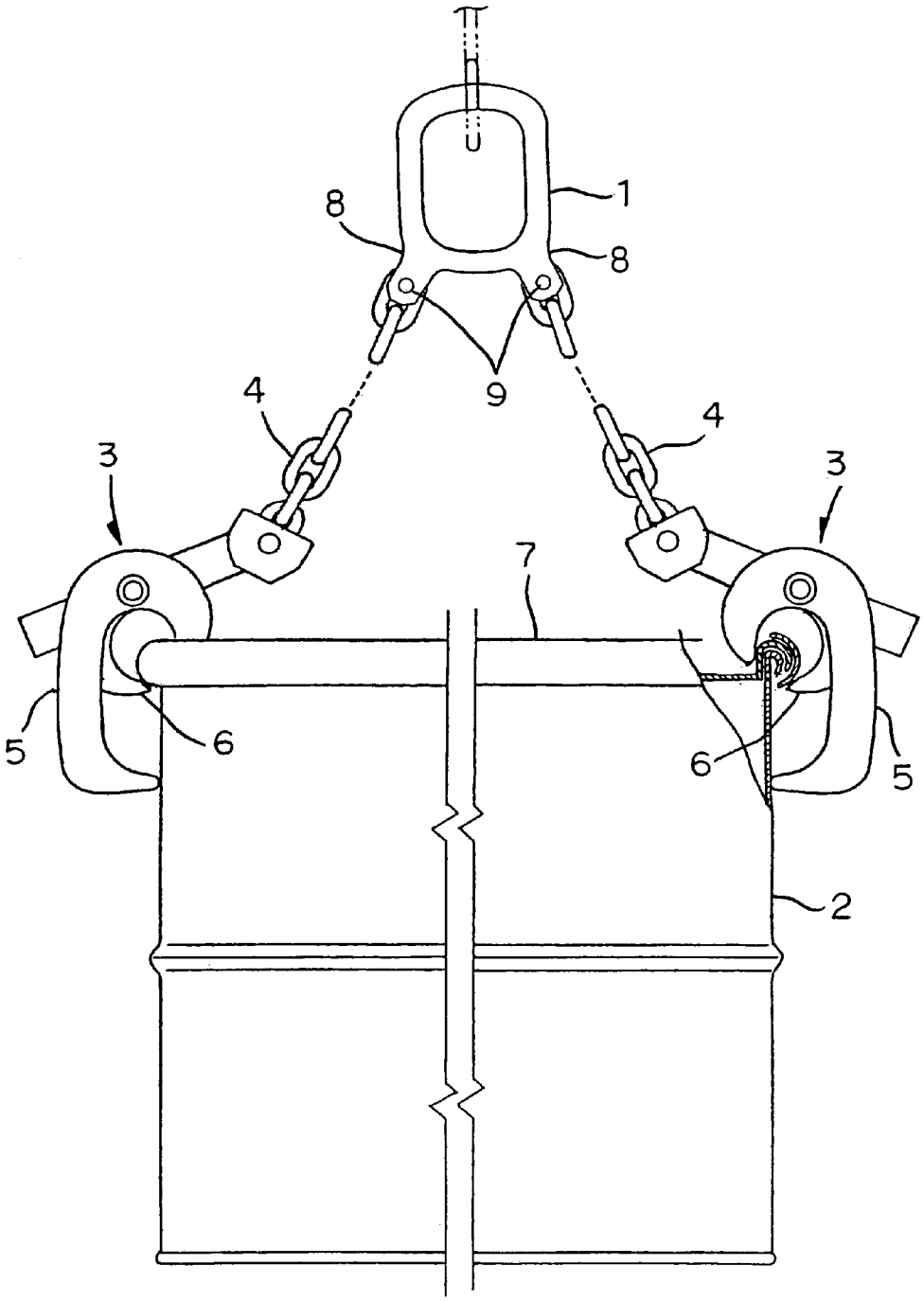
Prior Art FIG.26
FIG. 26 is a front view of the conventional type of chain sling.

With the conventional type chain sling as shown in FIG. 26, since the lower portions of the hook bodies 5 are bent at right angle to have a generally L-shape in section, as shown in FIG. 20, even when the drum 2 is provided, around its side surface, with holes 41 to insert the front ends of the lower portions of the hook bodies, the lower portions of the hook bodies inserted in those holes 41 can be easily slipped off from the holes 41 when the lower portions of the hook bodies 5 or the drum 2 is moved in the directions indicated by an arrow in the slinging work. Thus, good slinging work cannot be ensured.

Figure 21:
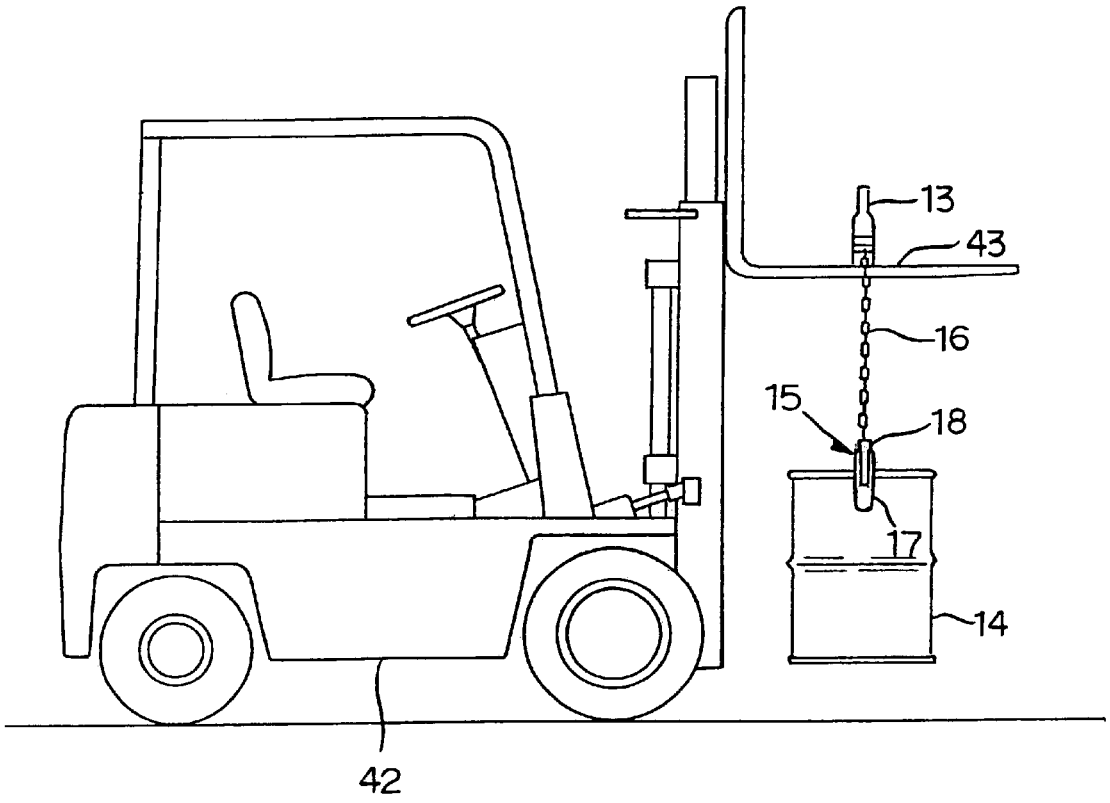
FIG. 21 is an illustration of the state in which a drum is raised by a forklift by use of the chain sling shown in FIG. 1.
Figure 22:
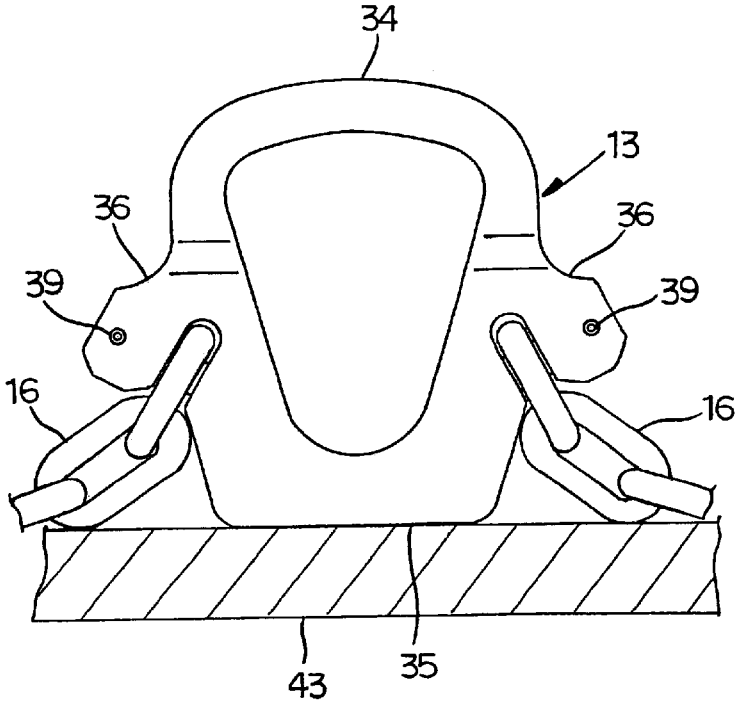
FIG. 22 is an illustration of the state of use of the master link of the chain sling of FIG. 21.

The master link 13 is usually hooked by a lower hook of a crane or a chain block but sometimes is raised by a forklift 42 and the like, as shown in FIG. 21. In the latter case, when a lifting portion 43 of the forklift 42 is inserted in the sling to abut with the lower portion 35 of the master link 13, a top surface of the lifting portion 43 is put into full contact with a flat bottom surface of the lower portion 35 without contacting with the connecting portions 36, as shown in FIG. 22. This is because the lower portion 35 of the master link 13 is formed to be flat and also the connecting portions 36 are formed at places above the lower or bottom portion 35. Thus, the master link 13 can then be stably supported by the lifting portion 43. Thus, the chain sling 11 of the present invention can be used with the forklift 42 as well as the crane and chain block with ease and reliability to raise the drum 14. Besides, since the connecting portions 36 are formed so that the two openings formed thereat can widen toward a lower place and also are coupled with the upper ends of the link chains 16 in the openings through the support shafts 37, the link chains 16 are prevented from being forced to abut with the lifting portion 43, thus ensuring the smooth slinging operation of the link chains 16.

Further, since the insertion holes 38 in the connecting portions 36 are formed along a plane containing the master link 13, the simple machining work of the insertion holes 38 and the reliable support of the link chains 16 can be yielded, as compared with the arrangement of the insertion holes 38 being formed along, for example, a plane containing a direction orthogonal to a plane containing the master link 13. In addition, the replacement of the support shafts 37 can be facilitated.

Figure 23:
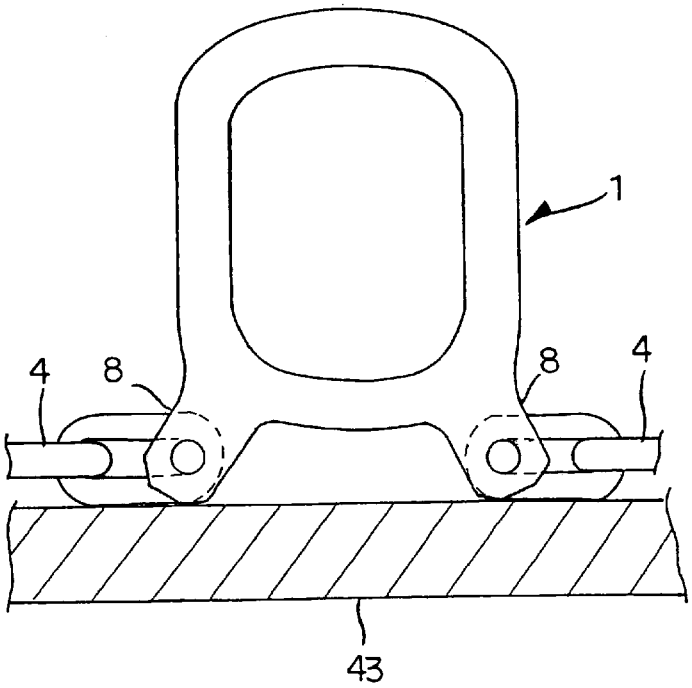
FIG. 23 is an illustration corresponding to FIG. 22 of the state of use of a master link of the conventional type of chain sling.

With the conventional chain sling as shown in FIG. 26, since the connecting portions 8 are formed to project downwardly from the lower portion of the master link 1, when the lifting portion 43 of the forklift is inserted from under the master link 1, the downwardly projecting connecting portions 8 are abutted with the lifting portion 43 of the forklift 42 to hinder the stable support of the master link 1, as shown in FIG. 23.

Further, since the insertion holes 30 in the connecting portions 28 formed at the grip portions 18 of the hooks 15 are also each formed along a plane containing the grip portions 18, the simple machining work of the insertion holes and the reliable support of the link chains 16 can be yielded, as compared with the arrangement of the insertion holes 30 being formed along, for example, a plane containing a direction orthogonal to a plane containing the grip portions 18. In addition, the replacement of the support shafts 29 can be facilitated.

While the discussion on the chain sling 11 used to sling the drum 14 was made in the above, the sling of the present invention is not limited to the chain sling used to raise the drum. For example, the sling of the present invention may also be used to raise another hanging load having no ring-like protrusion to be clamped in sandwich relation between the lower portions 26 of the grip portions 18 and the rear ends 20 of the hook bodies 17.

Figure 24:
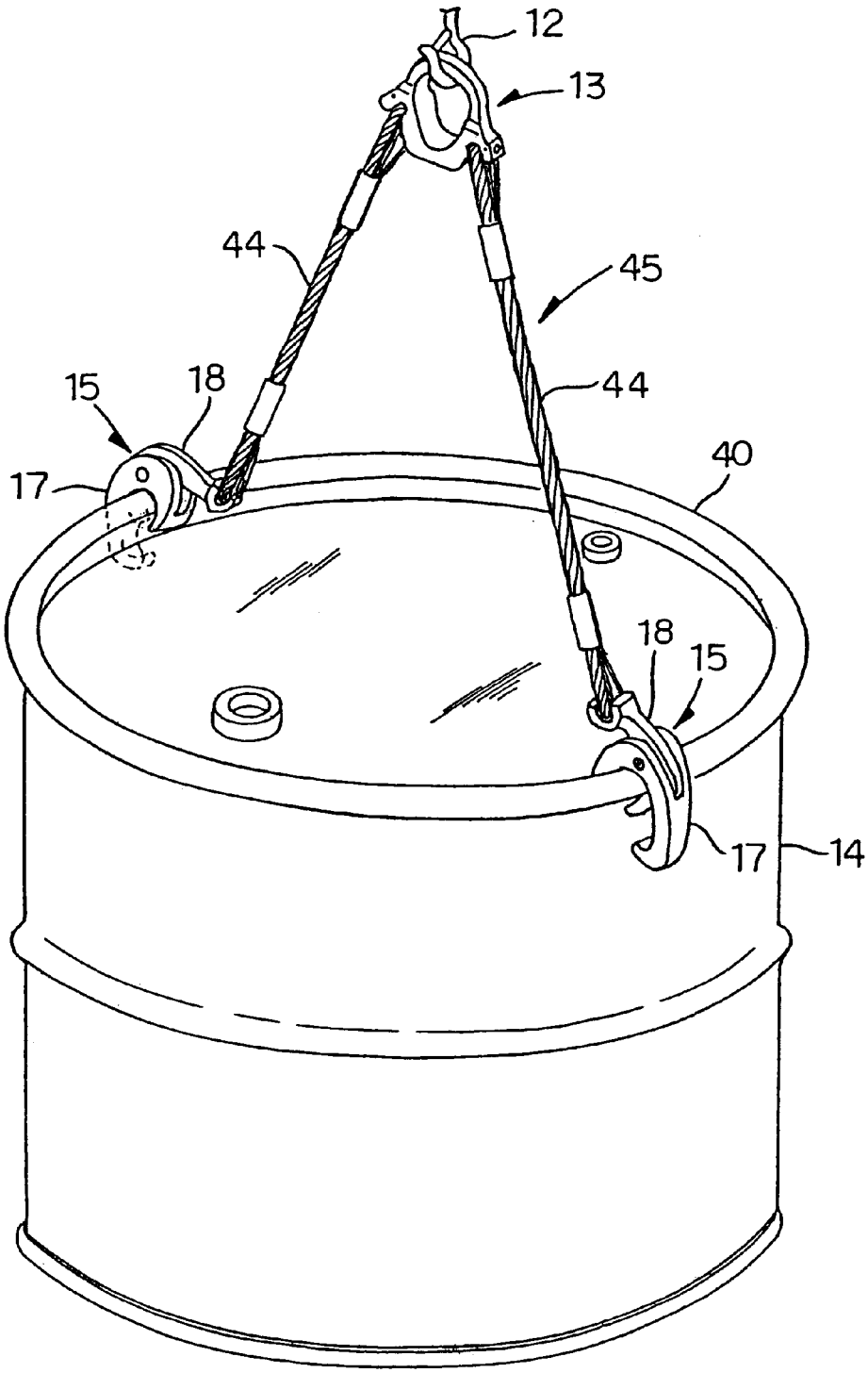
FIG. 24 is a perspective view of a wire sling of another embodied form of the sling of the present invention.
Figure 25:
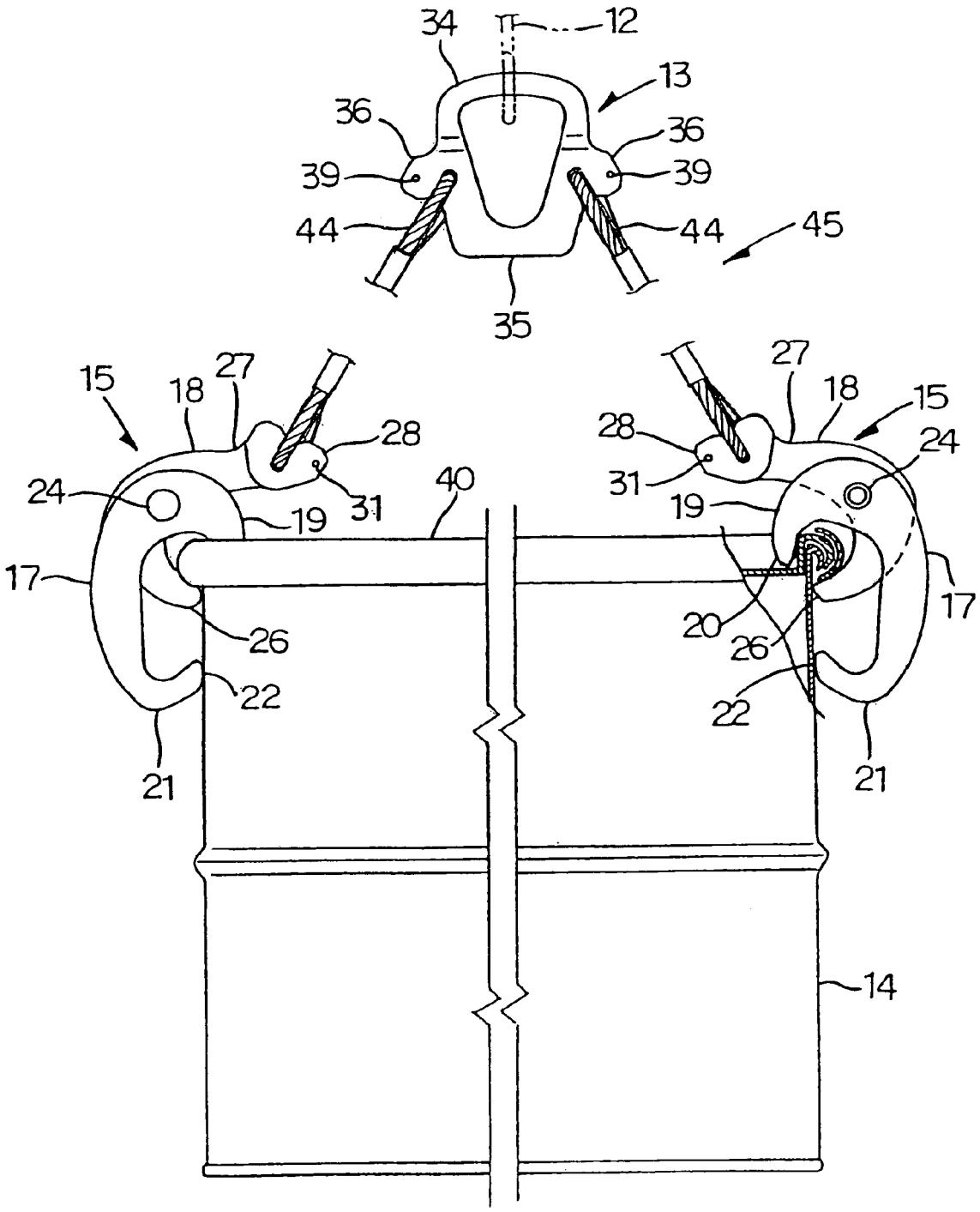
FIG. 25 is a front view of FIG. 24.

While the sling of the present invention was described above, taking the chain sling 11 as an example, the sling of the present invention cover the wire sling 45 in which the master link 13 and the hooks 15 are connected with each other through wire ropes 44 of flexible string-like members, as shown in FIGS. 24 and 25. Though some parts of the wire sling 45 are not shown in detail in FIGS. 24 and 25, the wire ropes 44 have upper eyes and lower eyes at their upper and lower ends. In the state in which those lower eyes of the wire ropes 44 are fitted in the openings of the connecting portions 28 formed into the generally U-shape in section, the support shafts 29 are inserted in the insertion holes 30 and the lower eyes of the wire ropes 44 and thereby the lower ends of the wire ropes 44 are connected with the grip portions 18. Also, in the state in which the upper eyes of the wire ropes 44 are fitted in the openings of the connecting portions 36 of the master link 13 formed into the generally U-shape in section, the support shafts 37 are inserted in the insertion holes 38 and the upper eyes of the wire ropes 44 and thereby the upper ends of the wire ropes 44 are connected with the master link 13.

In FIGS. 24 and 25, the same reference numerals refer to like members corresponding to those in the above.

Further, the sling of the present invention covers a belt sling in which the master link 13 and the hooks 15 are connected with each other through fiber ropes or straps as the flexible string-like members, though not specifically illustrated.

While the illustrative embodiments of the present invention are provided in the above description, such is for illustrative purpose only and it is not to be construed restrictively. Modification and variation of the present invention that will be obvious to those skilled in the art is to be covered in the following claims.

What is claimed is:

1. A sling for gripping and lifting a drum, comprising:

a master link;

hooks;

flexible string-like members for connecting said master link to said hooks;

a flat portion on at least a part of a bottom of said master link;

two connecting portions for connecting said flexible string-like members to said master link, each connecting portion disposed at an area above said flat portion;

wherein said flat portion of said master link is capable of being placed in contact with a lifting portion of a forklift;

wherein each hook comprises a hook body and a grip portion;

wherein a front end of said hook body orients to an upward direction from a horizontal direction when said drum is being held with said hooks;

wherein lower portions of said hooks have a bend of an angle smaller than 90°;

wherein said connecting portions comprise openings formed by a generally U-shaped section; and wherein said connecting portions have insertion holes formed along a plane of said master link, and said flexible string-like members are supported by support shafts inserted in said insertion holes, and wherein said insertion holes are in a direction orthogonal to said openings.

* * * * *